United States Patent [19]

Koike

[11] 4,398,461

[45] Aug. 16, 1983

[54] SMALL PRINTER

[75] Inventor: Isomu Koike, Shiojiri, Japan

[73] Assignees: Shinshu Seiki Kabushiki Kaisha; Kabushiki Kaisha Suwa Seikosha, Japan

[21] Appl. No.: 290,443

[22] Filed: Aug. 6, 1981

[30] Foreign Application Priority Data

Aug. 8, 1980 [JP] Japan ..... 55-109007
Sep. 2, 1980 [JP] Japan ..... 55-121617

[51] Int. Cl.[3] ..... B41J 1/48

[52] U.S. Cl. ..... 101/99; 101/110; 101/93.22

[58] Field of Search ..... 101/45, 90, 91, 92, 101/95, 96, 93.22, 109, 110, 77, 86, 87, 99

[56] References Cited

U.S. PATENT DOCUMENTS

| | | | |
|---|---|---|---|
| 2,770,188 | 11/1950 | Nolan | 101/93 |
| 3,330,207 | 7/1967 | DeMan | 101/92 |
| 3,920,113 | 11/1975 | Tamai | 197/51 |
| 3,946,666 | 3/1976 | Yokoyama | 101/99 |
| 3,967,550 | 7/1976 | Busch | 101/93.22 X |
| 4,003,307 | 1/1977 | Sano et al. | 101/45 |
| 4,111,117 | 9/1978 | Fezuka et al. | 101/99 |
| 4,152,982 | 5/1979 | Mikoshiba et al. | 101/93.22 |
| 4,161,912 | 7/1979 | Usui et al. | 101/99 |
| 4,244,290 | 1/1981 | Tamai et al. | 101/99 |
| 4,303,013 | 12/1981 | Shimodaira | 101/99 |

*Primary Examiner*—Edward M. Coven
*Attorney, Agent, or Firm*—Blum, Kaplan, Friedman, Silberman & Beran

[57] ABSTRACT

A printer of small overall size includes a plurality of typing wheels on the periphery of which are provided letters characters or symbols. At a printing position, a selection mechanism selects one of the plurality of letters, characters or symbols on each typing wheel. A printing mechanism prints the letter, character or symbols selected by the selection mechanism by applying a pressure thereto. A mechanism for feeding recording paper is arranged after the printing device in the feeding direction of the recording paper, and the printing mechanism moves in a direction opposite to the feeding direction of the recording paper after which pressure is applied to the printing device to effect printing.

21 Claims, 11 Drawing Figures

FIG. 5
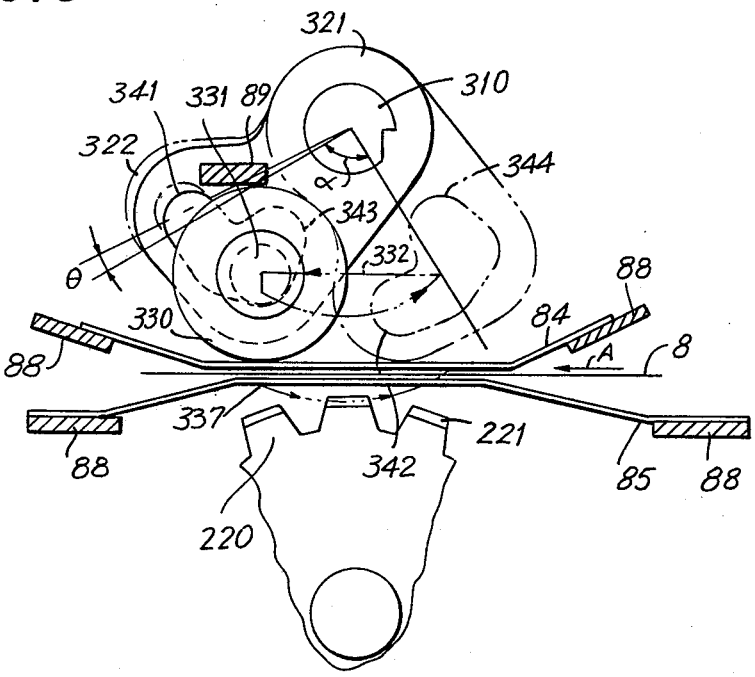
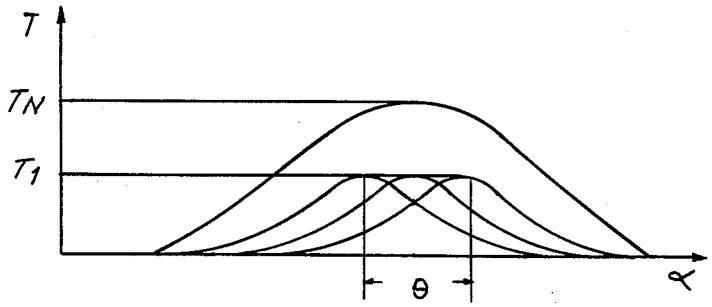
FIG. 6

FIG. 7
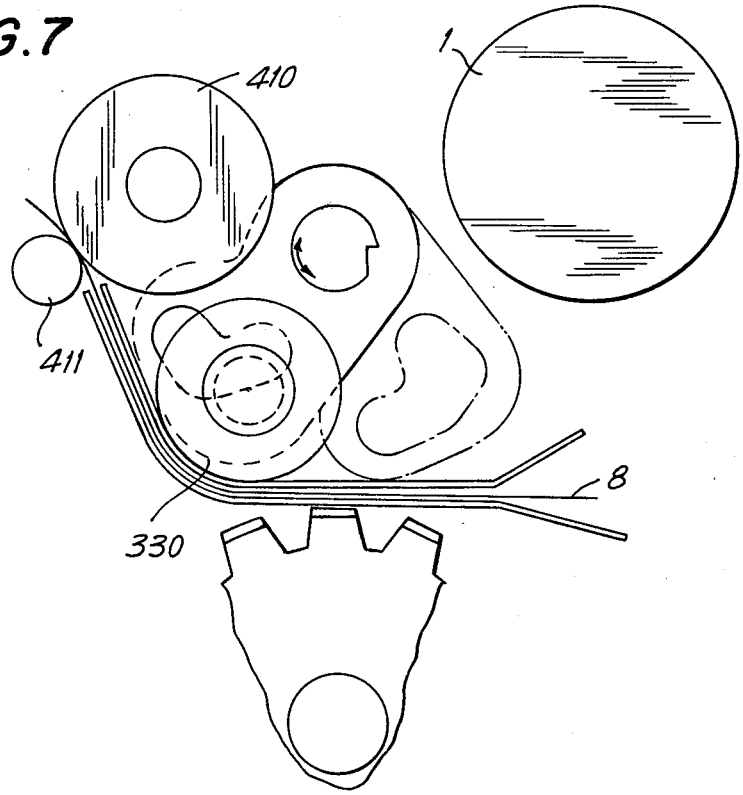
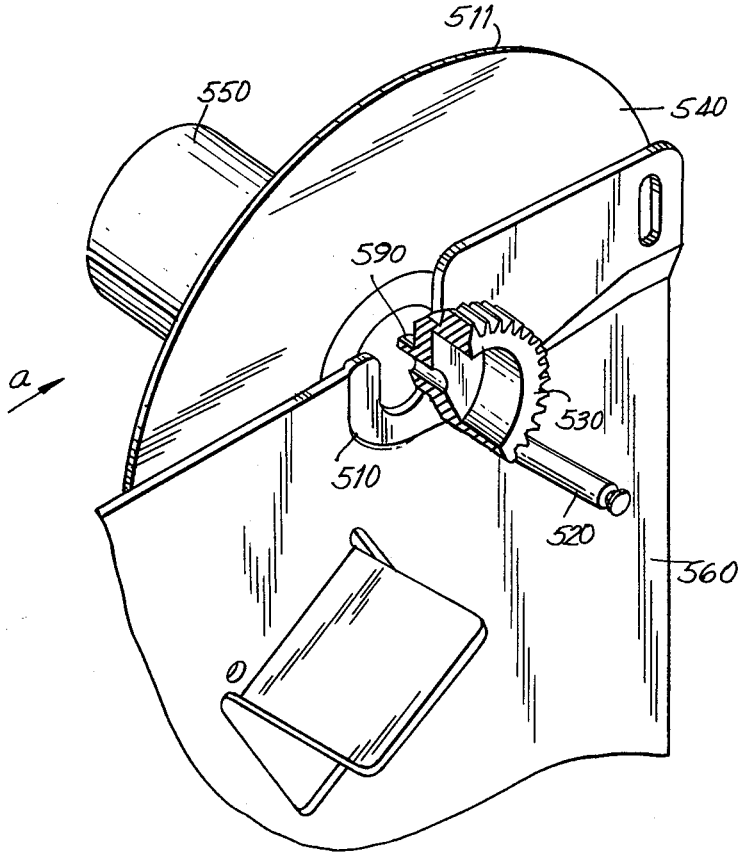
FIG. 10

SMALL PRINTER

BACKGROUND OF THE INVENTION

This invention relates generally to a small printing device using a type wheel selection system and more particularly, to a small printing device in which typing wheels are set at a desired position by a selection device, a paper is printed and thereafter is passed to a take-up device. The typing wheels include a plurality of numerals, letters or characters symbols, or the like on the external peripheral surface. The printing device is used for point-of-sale and electronic cash register applications.

Predominately, conventional printing devices having typing wheels are constructed in such a way as to frictionally drive the selected typing wheels and to effect aligned printing. Thus, conventional printing devices are unfit for ink roller type applications making it necessary to use an ink ribbon. This is a significant disadvantage, for example, in an electronic cash register which is subjected to heavy duty usage. Further, U.S. Pat. No. 2,770,188 discloses a construction wherein a ratchet and a ratchet wheel are engaged with each other and driven in a type wheel system. In this construction, however, there is the drawback that the electromagnetic actuation device must be energized until completion of the printing in order to maintain engagement between the ratchet and the ratchet wheel. Also, there is another significant drawback in that a ratchet wheel is required for each typing wheel. These factors increase the cost of the device and make it complex to manufacture.

Furthermore, as disclosed, for example, in the U.S. Pat. No. 3,920,113, assigned to the present assignees, another conventional printing device is of a pressure type. The device includes a printing roller rotatably held by a bearing plate which is provided with a bearing portion of a circular slot configuration and which is fixed to a crank shaft which continuously rotates in one direction. This conventional system has a major advantage in that the printing roller is in contact with and rolls on the surface of a typing wheel having letters or characters thereon, so as to apply a pressure, thereby producing a high printing pressure with a low torque. Such a printer is capable of copying using carbonless duplicating paper. However, with such a construction, there is an inconvenience that the diameter of the locus of the outer periphery of the printing roller which rotates, must be increased as the surface of the typing wheel having letters or characters increases. Thus, the printing device having a characteristic feature that the letters or characters are of large size, has a major disadvantage in that the structure as a whole is large and much space is required.

This system has another major disadvantage in that the printing roller is positioned a long distance away from the surface of the typing wheel having letters or characters and therefore a long distance from the printing paper, other than at the time of actual printing, thereby making it difficult to insert the printing paper to a desired preselected position. In addition, in this construction it is necessary to move the printing paper over a long distance immediately after completion of printing in order to confirm the quality of the printed letters or characters. Thus, there is also another drawback in that the distance between the printed lines must be increased. In addition, this system has another disadvantage in that the torque when pressure is applied and printing is effected, must be in proportion to the number of letters or characters to be printed.

As a swinging system for pressure printing, there has conventionally been known a method whereby the same letter or character is pressed and printed twice within one reciprocating motion of a pressing member, or a following line is printed during a return motion. In this case, however, there is not only a serious disadvantage in that a shear in printing is caused when the same letter or character is pressed and printed twice within one reciprocating motion, but also another disadvantage in that the time required for the printing is twice as long as that usually required. Thereby, printing speed is decreased. When a new line is started within one reciprocating motion, the direction of movement relative to the printing paper reverses, and thus the space between the lines becomes irregular. This is also a serious disadvantage.

Thus, for the reasons enumerated above, there are various types of serious disadvantages which are difficult to overcome in the conventional pressure printing constructions.

What is needed is a small printer capable of printing letters or characters of large size, with regularly spaced and aligned lines, by pressure techniques.

SUMMARY OF THE INVENTION

Generally speaking, in accordance with the invention, a small printer especially suitable for electronic cash register and point of sales applications is provided. The printing device is of small overall size and includes a plurality of type wheels around which are provided a plurality of letters, characters and symbols. The printing device also includes selecting means for selecting one of the plurality of letters, characters and symbols on the typing wheels, printing means for printing the selected letter, character or symbol by applying a pressure thereto, and feeding means for feeding a recording paper to be printed by the printing means. The feeding means is arranged after the printing means in the feeding direction of the recording paper. Means are also provided for moving the printing means in a direction opposite to the feeding direction of the recording paper and to then apply a pressure to the printing means as it moves over the typing wheel to effect printing. The printing means includes a pair of bearing plates fixed to an oscillating swinging crank shaft and provided with substantially L-shaped bearing grooves. The L-shaped grooves are formed by connecting circular shaft bearing grooves of long and short radii respectively. A printing roller, which engages the bearing grooves of the bearing plates is rotatably held. The printing roller engages the rotation shaft bearing grooves of long radii in the bearing plates and are driven so as to rotate when the printing means moves forwardly in oscillating motion. The printing roller engages the rotation shaft bearing grooves of short radii when the bearing plates are driven so as to rotate when the printing means moves backwardly in the oscillating motion. Also, control means operate to detach the printing roller from the surface of the selected character of the typing wheel during the backward motion.

Accordingly, it is an object of this invention to provide an improved printer of small size which is capable of printing letters or characters of large size as are required for a point of sale or an electronic cash register printer by the application of pressure, and wherein paper feeding is smoothly accomplished.

Another object of this invention is to provide an improved printer which eliminates non-alignment of lines which is caused by non-alignment of the typing wheels when printing is effected. Elimination of such defects as missing, smudged and broken letters is also desirable.

A further object of this invention is to provide an improved printer which is of small size, simple in construction low in cost and simple to assemble.

Still another object of this invention is to provide an improved printer wherein the period of time for passing an electric current through an electromagnetic actuator is made short, thereby decreasing the consumption of electrical energy.

Yet another object of this invention is to provide an improved printer having improved operational capabilities and ease of assembly and maintenance by providing a unitary printing selection device.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is a cross-sectional view of a pressure printing device in accordance with the present invention;

FIG. 6 is a graph showing the pressure printing load torque and rotational angle of the pressure printing devices of FIGS. 5 and 7, in comparison with prior art pressure printing devices;

FIG. 7 is a view similar to FIG. 5 of an alternative embodiment of a pressure printing device in accordance with this invention;

FIGS. 8, 9 and 10 are respectively a plan view, side view and perspective view of a take-up device in accordance with the present invention.

DESCRIPTION OF THE PREFERRED EMBODIMENTS

Figure 1:
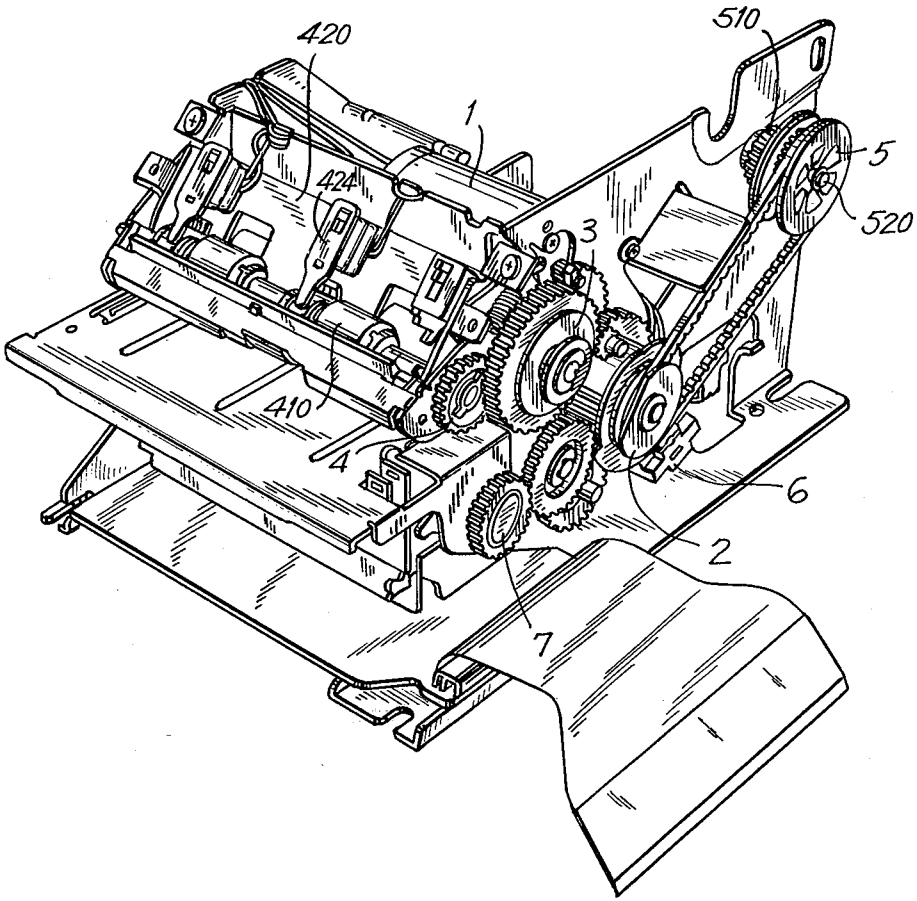
FIG. 1 is a top perspective view of a printer of small size in accordance with the present invention.

The printer in accordance with this invention provides a solution to the above-mentioned problems as explained in detail below. FIG. 1 is a perspective view of a printing device of small overall size constructed in accordance with the present invention. The printer includes a DC motor 1 which drives a typing wheel shaft 2 which drives a plurality of typing wheels by means of gears, and further drives an ink roller shaft 7. A gear 3 drives a pressure printing device and a gear 4 drives a paper feeding mechanism. A transmission gear 5 drives a take-up device and a detection device 6 detects a pulse which is generated in correspondence with the typing of a letter, character or the like by the printing wheel.

Figure 2:
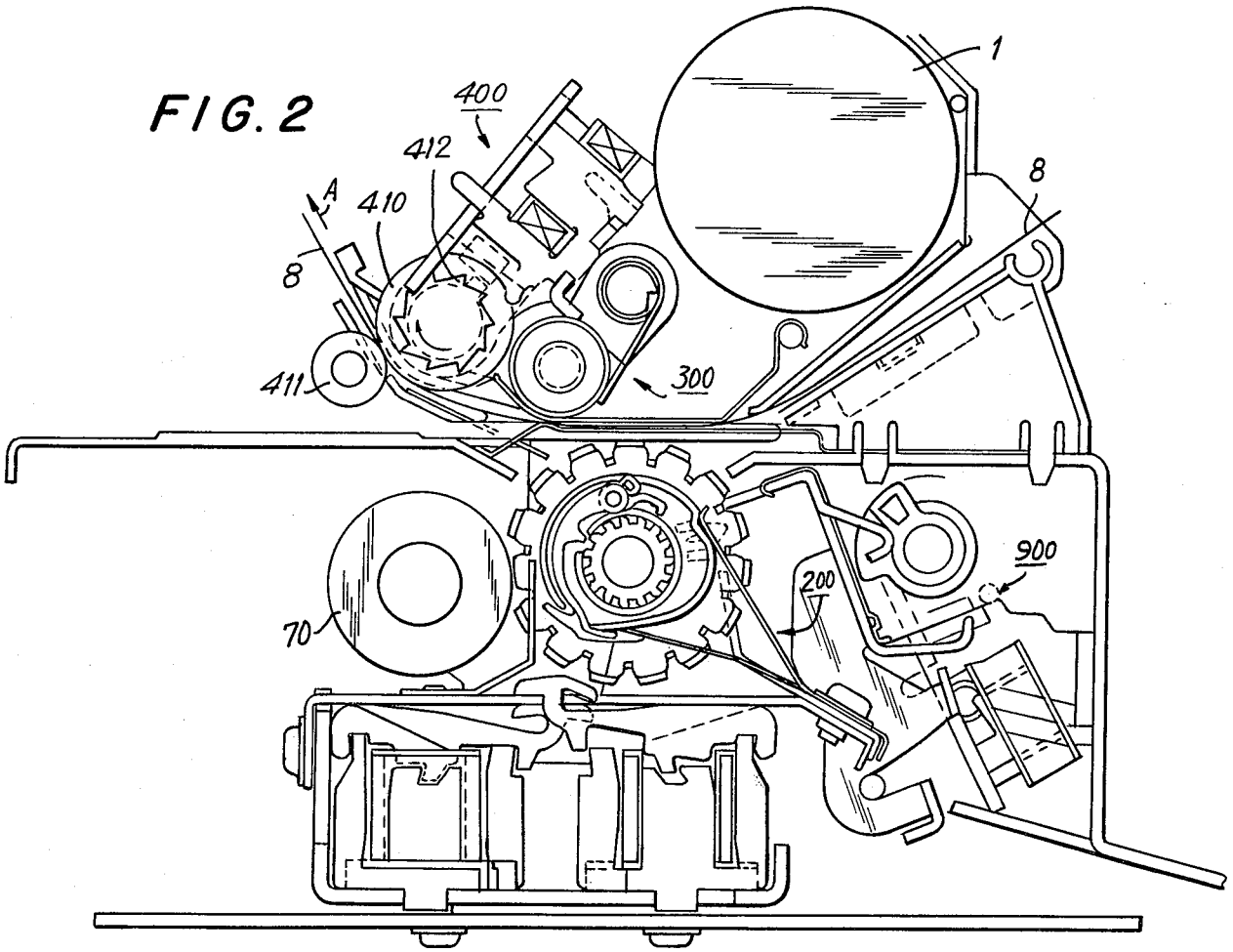
FIG. 2 is a side sectional view showing essential portions of the printer in accordance with this invention.

FIG. 2 is a sectional view showing essential parts of the printer in accordance with the present invention. Visible in FIG. 2 are a typing wheel and typing wheel selector 200, a pressure printing device 300, a paper feeding device 400, an ink roller 70, printing paper 8 and a typing wheel control device 900. The paper feeding device 400 is located at a forward position in the paper feeding direction, indicated by the arror A, with respect to the pressure printing device 300. The pressure printing device 300 moves in a direction opposite to the paper feeding direction A to effect the pressure printing.

Next, the major portions of the printer device in accordance with this invention are explained with reference to the various drawings.

Figure 3:
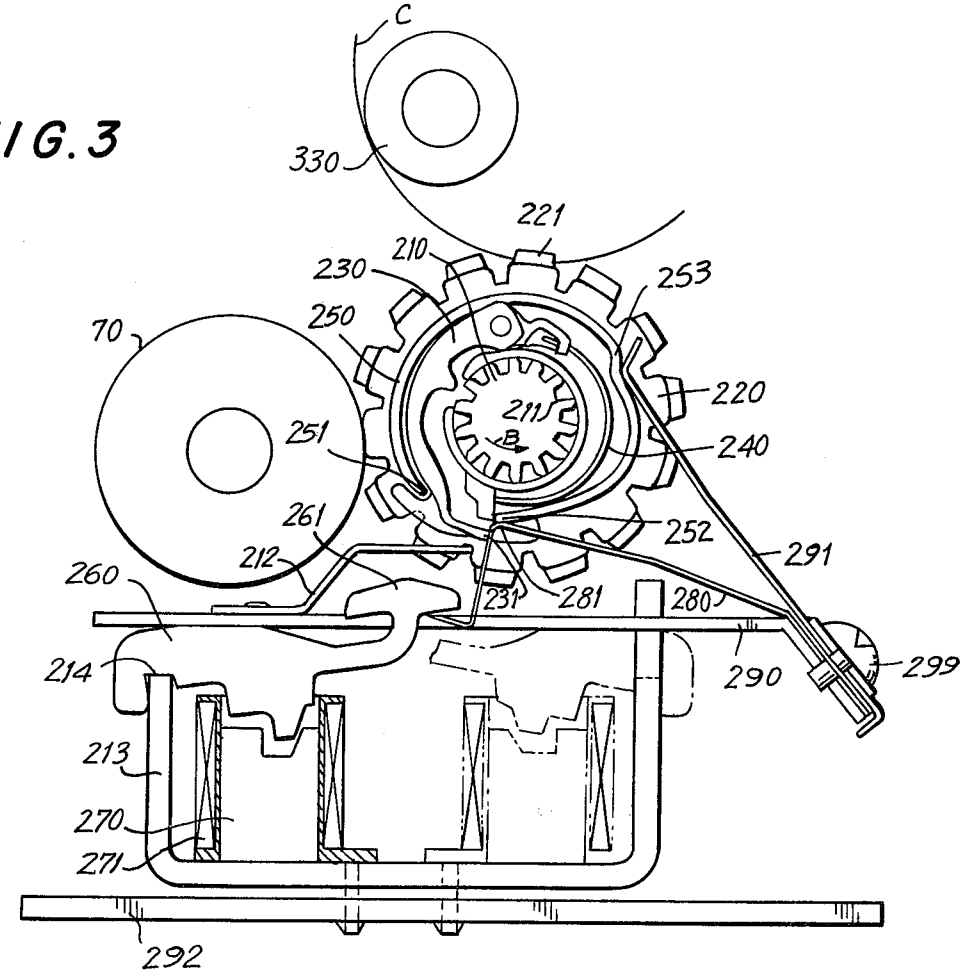
FIG. 3 is a cross-sectional view of a printing selection mechanism of the printer in accordance with this invention.

FIG. 3 is a sectional view of the typing wheel selector in accordance with this invention. A typing wheel shaft 210 is provided with a plurality of spline grooves 211 and is driven by a motor (not shown) so as to rotate in the direction indicated by the arrow B to execute a selection stroke. The selection stroke rotates and moves a typing surface 221 of a typing wheel 220 to a predetermined printing position. Then, the typing wheel shaft 210 comes to a standstill, and during that period, a printing roller 330 rotates, moving along a locus C of rotation and presses the selected typing surface 221 at the printing position. Thus, printing is accomplished.

It should be understood that a plurality of similar typing wheels 220 are mounted on the shaft 210 and operate in a similar manner to simultaneously print a line. Hereinafter, a description of the structure and operations relative to one typing wheel 220 is equally applicable to the other typing wheels. Further, similar components, performing similar functions are given the same reference numerals throughout the Figures.

After completion of the printing operation, the typing wheel shaft 210 again rotates in the direction indicated by the arrow B together with the typing wheel 220 which has finished printing. Thus, the shaft 210 is driven so as to rotate once and return the typing wheel 220 to the standby position as shown in the drawing. By having the speed in the returning portion after printing higher than that in the selection portion or stroke, the efficiency of the overall printing cycle is not lowered.

A clutch pawl 230 and a clutch spring 240 are located on a side surface of the typing wheel 220. The clutch pawl 230 is always energized, that is, acted upon, by the clutch spring 240 in such a manner as to be biased toward engagement with the spline grooves 211 of the typing wheel shaft 210 as explained more fully hereinafter. Around the outer periphery of the clutch pawl 230 and the clutch spring 240, a strip 250 is provided protruding from the side surface of the typing wheel 220. The protruding strip 250 is hereinafter referred to as a "detent guide" and the strip 250 is partially cut away and partially recessed. An end or head portion 231 of the clutch pawl 230 projects away from the cut-away portion of the detent guide 250. The ends 251,252, which define the cut-away portion of the detent guide 250, act as engaging surfaces of the clutch pawl 230 when in operation. That is, when the clutch pawl 230 is pivoted so as to engage the spline grooves 211 of the typing wheel shaft 210, the clutch pawl 230 is prevented from being further pivoted when the head portion 231 of the clutch pawl 230 abuts the end 252 of the clutch guide 250. Thereby, a predetermined positional relationship is maintained between the detent guide 250 and the clutch pawl 230.

As the typing wheel 220 is rotated to return its original position, the head portion 231 of the clutch pawl 230 contacts the bent portion 281 of a trigger spring 280 which disengages the pawl 230 from the spline groove 211 on the rotating shaft 210. When the clutch pawl 230 is released from engagement with the spline groove 211 of the typing wheel shaft 210, the head portion 231 of the clutch pawl 230 contacts the end 251 of the cut-away portion of the detent guide 250. Thus, the typing wheel 220 is prevented from overrunning and rapidly comes to a standstill at a position where a detent spring 291 is inserted into a recessed portion 253 of the detent guide 250, that is, in the standby condition as shown in the drawing of FIG. 3. In the standby condition, that is, in the condition where the engagement between the spline 211 of the typing wheel shaft 210 and the clutch pawl 230 is released, the typing wheel 220 does not freely rotate due to the detent spring 291 which provides a controlling force.

The trigger spring 280 is arranged such that the bent portion 281 thereof contacts the outer surface of the detent guide 250 of the typing wheel 220 by its own resiliency and also contacts the head portion 231 of the clutch pawl 230. One end of the trigger spring 280 and one end of the detent spring 291 are fixed by means of a screw 299 to one end of a draw plate holding member 290. The end of the trigger spring 280 engages the free end 261 of a draw plate 260 which is an armature member of an electromagnetic actuation device.

In the standby condition, the draw plate 260 is held away from a core 270 of the electromagnetic actuation device, and an electromagnetic coil 271 is wound around the core 270. When an electric current is passed through the electromagnetic coil 271, the draw plate 260 rotates about an end 214 on a yoke 213 which serves as a pivoting surface. The yoke 213 constitutes one portion of a magnetic path for the electromagnetic actuation device. When the draw plate 260 rotates about the center of rotation at the end 214, engagement between the bent portion 281 of the trigger spring 280 and the head portion 231 of the clutch pawl 230 is released.

A plate 292 supports the electromagnetic coil 271. A typing wheel guide 212 maintains the position of the typing wheel 220 in the transverse direction, that is, in the direction of the shaft 210. An ink roller 70 is forced to rotate such that the peripheral speed of the typing wheel surface 221, by rotation of the typing wheel shaft 210, coincides with the peripheral speed of the outer surface of the ink roller 70.

In the embodiment in accordance with the present invention, as described above, when the typing wheel shaft 210 is to effect a selected rotation of the typing wheel 220 in accordance with input information, a short pulse-like signal is developed so as to instaneously energize the associated electromagnetic coil 271. Thus, the draw plate 260 is pulled and pivots against the spring 281. Then, the bent portion 281 of the trigger spring 280 is pushed away from the outer surface of the detent guide 250 so as to release its engagement with the head portion 231 of the clutch pawl 230. As a result, the clutch pawl 230 pivots counterclockwise, as seen in the drawing, as a result of the spring force applied by the clutch spring 240. Thus, the clutch pawl 230 engages a spline groove 211 of the typing wheel shaft 210. By this engagement, the typing wheel 220 and the typing wheel shaft 210 are coupled together and the clutch pawl 230 comes into contact with the end 252 at the cut-away portion of the detent guide 250 on the typing wheel 220. This contact brings pivoting of the clutch pawl 230 to a halt.

When energization of the electromagnetic coil 271 for a short time period has ceased, the trigger spring 280 moves the draw plate 260 away from the core 270 by its own resilience, and in the same time the bent portion 281 of the spring 280 slides along the outer surface of the clutch pawl 230 until it comes in contact with the outer peripheral surface of the detent guide 250.

As the typing wheel shaft 210 rotates for a selection stroke from the reference position in the described manner, the same operation is acccomplished at the typing wheel portion of each column, and the typing wheels of 220 successively are coupled to the typing wheel shaft and start to rotate. Thus, when one rotation of the selection stroke has been completed and the typing wheel shaft 210 comes to a standstill, the typed letters or characters, in correspondence with the input information, are put into proper relative positions opposite to the printing roller 330. During the stationary period, the printing roller 330 moves along the locus of rotation so as to effect the printing operation.

When the printing operation is ended, the typing wheel shaft 210 again starts to rotate with the typing wheels 220. As stated above, the bent portion 281 of the trigger spring 280 at this time already occupies a position in contact with the outer surface of the detent guide 250. The head portion 231 of the clutch pawl 230, which is rotated together with the typing wheel 220, comes into contact with the bent portion 281 of the trigger spring 280 and is pushed back until it reaches the end 251 of the cut-away portion of the detent guide 250. Therefore, the clutch pawl 230 is pivoted clockwise so as to release engagement with the spline groove 211 and free the typing wheel 220. At the same time, the end of the detent spring 291 falls into the recessed portion 253 of the detent guide 250. Thus, the typing wheel 220 soon comes to a standstill without moving freely, at a predetermined position due to the controlling force of the detent spring 291. Thereby, one cycle is complete. With each of the typing wheels 220 selected and rotated once, all of the typing surfaces 221 come into contact with the ink roller 70 during one rotation through the selection stroke and the returning stroke, thereby coating ink on each typing surface 221.

Figure 4:
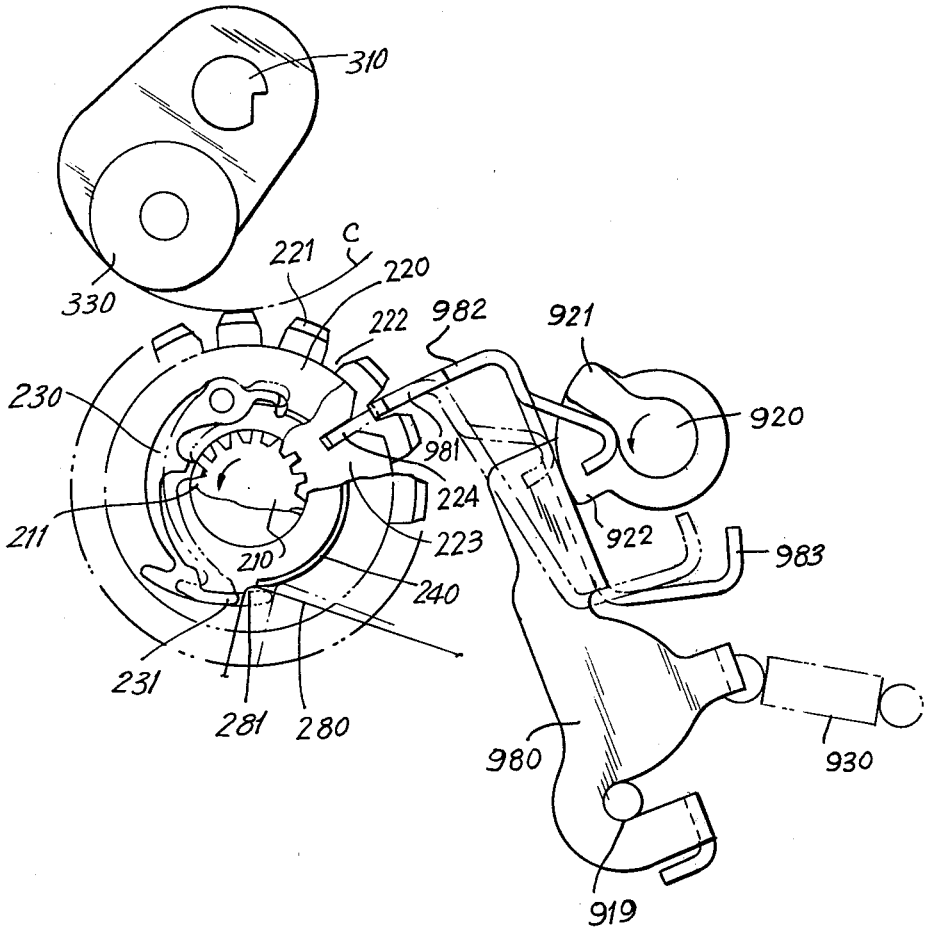
FIG. 4 is a sectional view of a typing wheel control device of the printer in accordance with this invention.

FIG. 4 is a sectional view of a typing wheel control mechanism constructed in accordance with this invention. The typing wheel shaft 210, which includes the spline grooves 211, is shown together with a typing wheel shaft control cam 223. The shaft control cam 223 is integral and coaxial with the spline grooves 211. As stated, the typing wheel shaft 210 is selectively rotated once, comes to a standstill and is rotated to its standby position by means of a driving mechanism (not shown). The typing wheel 220 is arranged on the typing wheel shaft 210, and on the peripheral surface of the typing wheel 220, typing surfaces 221 and typing wheel control cam grooves 222 are provided alternately.

The clutch pawl 230 is energized by the clutch spring 240 and mounted on the side surface of the typing wheel 220 as described above. A crank shaft 310 is rotated by a driving device (not shown) and the printing roller 330, which is eccentrically mounted to the crank shaft 310, moves along the locus C at the outer periphery of rotation. The crank shaft 310 is operated in synchronism with the typing wheel shaft 210 such that when the typing wheel shaft 210 is stationary, the selected typing surface 221 of the typing wheel 220 engages the printing roller 330 thereby effecting the pressure printing.

A typing wheel aligning plate 980 is located between a pivot shaft 919 and an aligning plate driving cam 921. The typing wheel aligning plate 980 is biased in a clockwise direction by means of an aligning plate return spring 930. The typing wheel aligning plate 980 is provided with a typing wheel shaft operating portion 981 which engages and actuates a shaft control groove 24 on the typing wheel shaft control cam 223. The typing wheel aligning plate 980 is also provided with a typing wheel operating portion 982 which engages and actuates the typing wheel control cam groove 222.

When the typing wheel shaft 210 is stationary, the typing wheel aligning plate 980 is pivoted about the rotation shaft 919 as a center of rotation by the rotating push-in cam portion 921 of the aligning plate driving cam 920. Then, first, the typing wheel shaft operating portion 981 engages and actuates the shaft control groove 224 in the typing wheel shaft control cam 223. After that, the typing wheel operating portion 982 engages and actuates the typing wheel control cam groove 222. The typing wheel aligning plate 980 is provided with an operating portion 983 for forcibly returning the plate 980. If not returned by means of the aligning plate return spring 930, engagement of the operating portion 983 with the forcibly returning cam portion 922 of the aligning plate driving cam 920 causes the return operation of the aligning plate 980.

When the trigger spring 280 is actuated during the selective rotation of the typing wheel shaft 210 in correspondence with an electric input pawl signal, the clutch pawl 230 engages the spline groove 211 so that the typing wheel 220 rotates in synchronism with the typing wheel shaft 210 as described above. Thus, when the typing wheel shaft 210 comes to a standstill together with the successively and selectively rotated typing wheels 220, the typing wheel aligning plate 980 is actuated at the same time by the push-in cam portion 921 of the aligning plate driving cam 920. Then, first of all, the typing wheel shaft operating portion 981 engages the shaft control groove 224 of the typing wheel shaft control cam 223 so as to slightly rotate, if misaligned, and control the typing wheel shaft 210 in a correcting manner, that is, in an aligning manner. At the same time, the typing wheel 220 is also aligned. That is, the typing wheel operating portion 982 falls into the typing wheel control cam groove 222, thereby supplementally rotating the typing wheel 220 in an aligning and controlling operation. The typing wheels 220 and the typing wheel shaft 210 are in the desired position. The actuated position of the typing wheel aligning plate 980 is shown with broken lines in FIG. 4.

While the typing wheel 220 is constrained and aligned by the typing wheel aligning plate 980, the printing roller 330, which is driven by the crank shaft 310 as described above, presses and prints the selected typing surface 221. The typing wheel aligning plate 980, which has constrained and aligned the typing wheel 220 during the time that the printing roller is in contact with the typing surface, returns to the position indicated by the solid lines, by the force of the aligning plate return spring 930 or the forcible action of the returning cam portion 922 of the aligning plate driving cam 920. This forcing action is effected if it is impossible to return the typing wheel 220 by the spring force immediately after the completion of printing, that is, immediately after the printing roller 330 has separated from the typing surface 221. When the typing wheel aligning plate 980 returns to its standby position, the typing wheel shaft 210 again rotates, as previously described, together with the typing wheel 220, whereupon the return trigger spring 280 engages the clutch pawl 230. When the engagement between the clutch pawl 230 and the spline groove 211 is released, the typing wheel 220 returns to the standby condition as indicated by the solid lines in the drawing. Thus, the typing wheels 220 successively return to the standby condition and thereby a selective printing operation is completed.

FIGS. 5 and 7 are sectional views of alternative embodiments of pressure printing mechanism in accordance with the present invention. The crank shaft 310 is driven in such a way so as to oscillatingly swing through a desired rotational angle $\alpha$ by means of a driving mechanism (not shown). Bearing plates 321,322, which are mounted on the crank shaft 310, are driven together in such a way as to swing oscillatingly with the shaft 310. Each plate 321,322 includes a bearing portion 341 having a long radius of rotation, and a bearing portion 343 having a shorter radius of rotation about the crank shaft 310. The bearing portions 341,343 are connected so as to provide a substantially L-shaped bearing hole. The substantially L-shaped bearing holes in the bearing plates 321,322 are fixed to the crank shaft 310 with a phase difference $\theta$ ($\theta>0$).

A printing roller 330 on a shaft 331 is provided between the bearing plates 321,322. The shaft 331 of the printing roller 330 is rotatably supported by the bearing plates 321,322 in the substantially L-shaped bearing hole which includes the bearing portions 341,343 of the bearing plates 321,322.

When the typing wheel 220 rotates so that the center of the selected typing surface 221 reaches a line defined between the centers of the crank shaft 310 and the typing wheel 220, the typing wheel 220 comes to rest. At this moment, the typing surface 221 is pressed upon and typed on the printing paper 8 by means of the crank shaft 310 which is rotated counterclockwise. That is, the printer roller 330 which is held by the bearing plates 321,322 passes over the selected typing surface 221. Then, the roller 330 pivots back so as to return to the standby position. Thus, a selective two step oscillating rotation is effected. In this way, the printing roller 330 when pressing is moved in a direction opposite to the paper feeding direction A, thereby effecting a pressure printing.

Printing roller control springs 84,85 control the motion of the roller 330 and also function as a paper guide. A square hole, not visible in the drawings, is formed at the portion of the control springs corresponding to the typing surface 221 of the typing wheel 220 which is to be printed. When pressure typing is effected, the printing roller 330 is adapted to directly push the printing paper 8 onto the typing surface 221 of the typing wheel through the square holes. The printing roller control springs 84,85 are made of an elastic material. Both ends of the control springs are supported by a member 88 which is part of a frame (not shown). In addition, reference numeral 89 on the drawing represents a printing roller stopper, which is provided to stop the clockwise rotation of the crank shaft 310 and prevent the printing roller 330 from floating up and make it wait in the stable condition.

In accordance with the present invention as described above, any selected typing wheel 220 is brought to a standstill with any selected typing surface 221 directed toward the center of the crank shaft 310. The printer is comprised of a plurality of typing wheels 220 mounted on the common shaft 210 so that when all the typing wheels 220 come to a standstill with a selecting typing surface 221 directed toward the center of the crank shaft 310, the crank 310 is rotated counterclockwise from the standby condition shown in solid lines. When the crank shaft 310 rotates, that is, the connected bearing plates 321,322 are rotated, the rotational shaft 331 of the printing roller 330 enters the bearing portion 341 having the long rotation radius. Then the outer periphery of rotation of the printing roller 330 moves along the broken line 337 as indicated by the arrows. As the printing roller 330 moves, the printing roller control springs 84,85 as well as the printing paper 8 which is held therebetween, approach the typing surface 221 of the typing wheel 220. When the crank shaft 310 is further rotated counterclockwise, the printing paper is completely pushed against the typing surface 221 for printing on the paper 8.

When the centers of the crank shaft 310, the printing roller 330 and the typing wheel 220 are arranged on a straight line, the pushing force is a maximum. In accordance with the present invention, the center of the typing surface 221 of each typing wheel 220 lies precisely on a straight line connecting the center of the crank shaft 310 and the center of the typing wheel 220. Since the substantially L-shaped bearing grooves 341,343 of the bearing plates 321,322 are positioned with a phase difference $\theta$, the moment when the centers of the typing wheel 220, the printing roller 330 and the crank shaft 310 are arranged on a straight line, that is, when the pushing force is a maximum, differs for each typing wheel 220 by a small amount of time. Thus, the crank shaft 310 stops its counterclockwise rotation when the center of the letter or character on the typing surface 221 is passed on the last typing wheel 220 in the transverse row of typing wheels, and the printing roller 330 goes further and passes the end of the letter or character on the last typing surface 221. Thereby, printing is accomplished.

In this construction (FIG. 5) the printing roller 330 is subjected to a force which is directed upwards as seen in the drawings by the printing roller control springs 84,85. Thus, when the crank shaft 10 rotates back, that is, in a clockwise direction, the rotation shaft 331 of the printing roller 330 moves from the long radius rotation shaft bearing portion 342 of the bearing plates 321,322 to the shorter radius rotation shaft bearing portion 344. This counterclockwise position, at the start of the clockwise motion, is shown with broken lines in FIG. 5. As the crank shaft 310 rotates clockwise, the printing roller 330 moves horizontally (FIG. 5) as shown by the broken line 332 while being supported in this elevated position by the printing roller control spring 84.

At this time, since the printing roller 330, the printing paper 8 and the typing surface 221 of the spring wheel 220 are held apart from each other by the printing control springs 84,85, the returning rotation of the typing wheel 210 to the standby condition is effected simultaneously with the returning rotation of the crank shaft 310 as described above. When the crank shaft 310 returns to the standby condition as shown by the solid lines in FIG. 5, the printing roller 330 also strikes against the printing roller stopper 89, stops and returns to the standby condition. Thus, the center of the printing roller 330 moves as shown by the broken line 332 and the outer periphery of the printing roller moves to print as shown by the broken line 337 in response to a oscillatingly swinging motion of the crank shaft 310. The return portion of the broken line 337 is not shown in FIG. 5 but, as stated, the roller 330 is supported by the spring 84.

FIG. 6 shows the relationship between the pressure printing load torque and the rotational angle $\alpha$ of the crank 310. The phase difference $\theta$ for the occurrence of the peak torque $T_1$ for each typing wheel 220 is shown. The instantaneous total torque has a peak $T_N$ which is less than $T_1 \times N$, where N is the number of typing wheels. N is 3 in the illustration of FIG. 6. In other words, the peak torque $T_N$ is less than the sum of the individual peak torques $T_1$ if these individual peaks were to occur simultaneously.

FIG. 7 shows an alternative embodiment of a pressure printing construction in accordance with this invention. In this construction, the printing roller 330 acts as the guide for the printing paper 8. This is not done in conventional printing systems. Additionally, a paper feeding roller 410 and a paper holding roller 411 are positioned in the vicinity of the printing mechanism. Therefore, by using the roller 330 also as a guide, the path for the printing paper 8, which is a most serious problem in the design of a printer mechanism, is made short. Further, by such an arrangement, space may be provided for locating other mechanical parts such as the motor 1, thereby decreasing the size of the printing device as a whole, and a high degree of freedom is available for the layout of the overall printer system.

Figure 8:
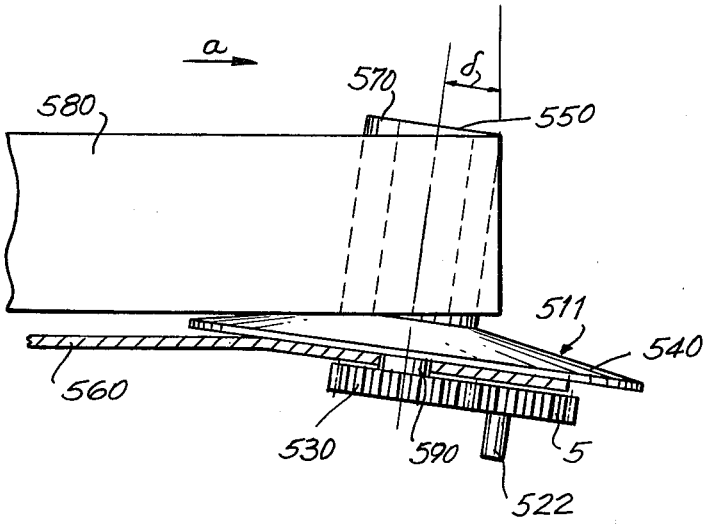
Figure 9:
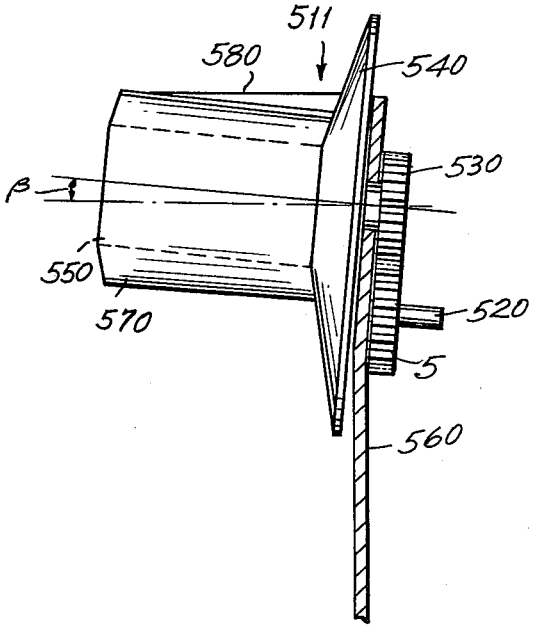

FIGS. 8,9 and 10 are respectively a plan view, a side view and a perspective view of a take-up device 511 in accordance with the present invention. A transmission gear 5 transmits power from an external power source and a transmission shaft 520 supports the transmission gear 5. A take-up gear 530 is in engagement with the transmission gear 5, and a take-up flange plate 540 is integral with the take-up gear 530. A take-up shaft 550 is also integral with the take-up gear 530. A frame 560 is on the journal side and a recording paper 570 is taken up on the journal side. A recording paper 580 is being taken up. One portion 590 of the take-up shaft 550 engages a holding portion 510 of the frame 560 for holding the take-up unit 511. Thus, for supporting the take-up shaft 550, the take-up device utilizes a cantilever supporting system. The frame 560 on the journal side and the take-up shaft 550 have an angle $\delta$ with respect to the direction perpendicular to the running path of the recording paper 580 as indicated by the arrow a.

Having the take-up shaft 550 at an angle $\delta$ with respect to the direction perpendicular to the running path, in the direction indicated by the arrow a, of the recording paper produces the following effects.

First, as a consequence of the angle for the take-up shaft 550, the recording paper 580 is in contact with the take-up shaft 550 only near the end of the take-up shaft 550. At this contact portion, a tensile force is generated in the recording paper 580.

Secondly, inasmuch as the take-up shaft 550 has an angle with respect to the recording paper 580, and the recording paper 580 is under a tensile force at the end of the take-up shaft 550, the recording paper 580 is pushed against the take-up flange plate 540 due to a belt effect.

In order to prevent meandering the coiled expansion, as well as to align the end surface of the recording paper 570 which is wound around the take-up shaft 550, it is required that the recording paper 580 be pushed against the take-up flange plate 540 and, at the same time, for the recording paper 570, which is taken up, to be fastened at the end of the take-up shaft 550.

The take-up unit 511 is mounted with an inclination of an angle $\beta$ with respect to the vertical direction of the frame 560 (FIG. 9). Therefore, the recording paper is pushed towards the take-up flange plate and is thus taken up. As a result, the cantilever flange has the same function and effect as with a flange plate where both ends are supported. A perspective view of this take-up unit 511 is shown in FIG. 10.

Figure 11:
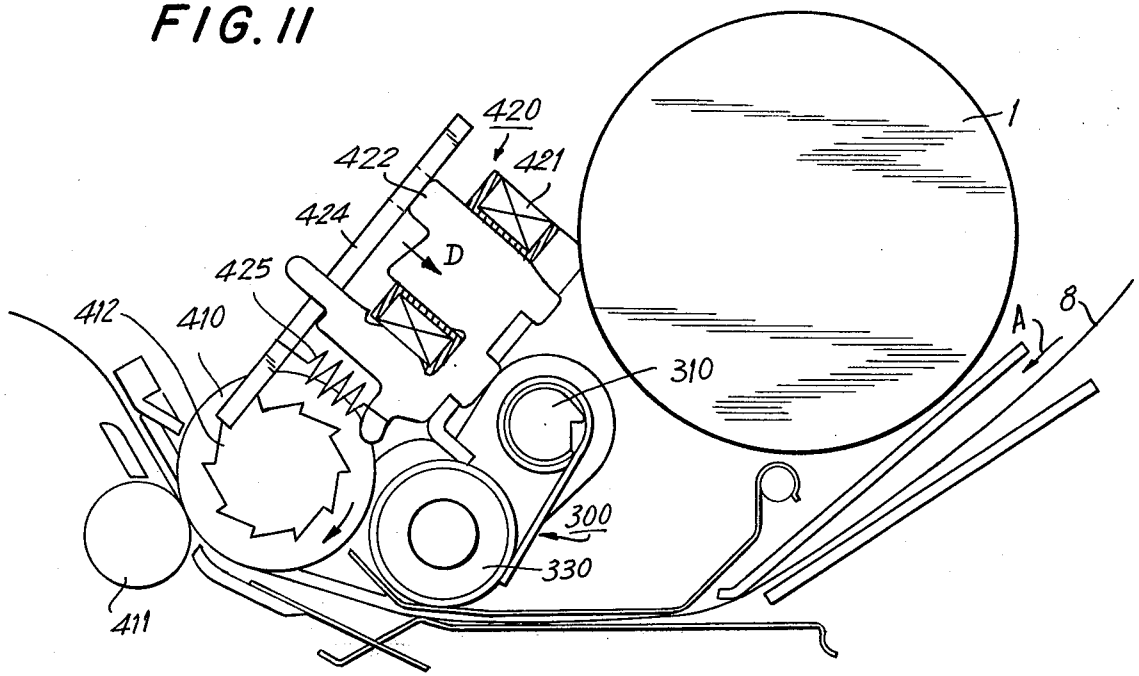
FIG. 11 is a sectional view of a paper feeding device in accordance with the present invention.

FIG. 11 is a sectional view of a paper feeding device in accordance with this invention including a paper feeding roller 410 and a paper holding roller 411. A ratchet gear 412 engages the paper feeding roller 410 as well as a one-way spring clutch (not shown) and the paper feeding driving gear 4 (FIG. 1). An electromagnetic device 420 effects the engagement and non-engagement operation of the paper feeding driving gear 4 with the paper feeding roller 410. The electromagnetic device 420 includes a coil 421, a yoke 422, an engaging lever 424 and a bias spring 425.

First, after completion of printing by the printing device, or when paper feeding is desired, the coil 421 is fed an electrical pulse of short duration so as to energize the yoke 422 and move the engaging lever 424 in the direction indicated by the arrow D against the force of the spring 425. Then, engagement between the engaging lever 424 and the paper feeding ratchet gear 412 is released. Thereby, the ratchet gear 412 rotates by an amount corresponding to one tooth. Thereby, the paper feeding roller 410 rotates by a predetermined amount and the paper feeding ratchet gear 412 again engages the engaging lever 424 so as to stop rotation of the paper feeding roller 410. When the paper feeding roller 410 rotates in this way, a predetermined amount equivalent to at least one printed line of recording paper 8 is fed.

A small printer constructed as described above, in accordance with this invention provides the following effects. Inasmuch as the spline grooves are integrally provided on the typing wheel shaft itself, the clutch pawl is arranged so as to approach the vicinity of the center of the typing wheel as closely as possible, thereby making it possible to provide a space to locate a detent guide on the outer periphery of the typing wheel. Furthermore, the outer surface of the detent guide is made the sliding surface of the armature member (draw plate) or any other member, for example, the trigger spring, which moves together with the armature member. Therefore, it is possible for the armature member to always be in a position to engage the clutch pawl. At the same time, it is possible to limit the movement when the clutch pawl pivots by the end of the cut-away portion of the detent guide. In addition, one portion of the detent guide is provided with a recess for controlling the detent, thereby completely preventing free movement of the typing wheel in the standby condition. Thus, signals which are required in one cycle of the printing motion are sufficient with only short pulse signals being inputted at required rotational positions of the typing wheel shaft.

After having released engagement with the clutch pawl, the armature member (draw plate) which is driven by means of these short pulse signals, or any other member (trigger spring) which moves together with the armature member, comes into sliding contact with the outer surface of the detent guide as stated above so as to be in a position to disengage the clutch pawl. Thereby, actuation of the pawl is reliable. In addition, the detent guide is provided on the outer surface of the clutch pawl and clutch spring thereby preventing the clutch pawl and clutch spring from overtravel. Also, accummulation of dust is prevented. Thereby, free movement of the detent is prevented and engagement and release from engagement between the clutch pawl and the spline grooves is made reliable. Thereby, reliability is greatly enhanced and electric energy consumption is diminished.

Also, because the spline grooves are provided on the typing wheel shaft itself, no ratchet wheel paired with the typing wheel shaft is necessary. Thereby, the number of parts is decreased at the same time as the number of steps required in assembly is reduced. Furthermore, the printing selection mechanism is completely and integrally unitary. Thereby, the number of steps needed in the manufacturing assembly is further decreased and the ease of handling during production, as well as in servicing and maintenance for the user, is improved.

Also, since the position of the typing wheel shaft and the typing wheel itself is corrected at the moment of printing in such a manner that they are constrained and aligned by means of one member, that is, the typing wheel aligning plate, the connection between the printing system and the typing wheel selection system, which has been a problem in the past, is ended.

Applicable fields for the printer in accordance with this invention are not limited to only a typing wheel selection system of one rotation clutch type, and to a printing system using a printer roller. In addition, the present invention is very advantageous in cost, quality and reliability. Furthermore, the bearing portion for the shaft of the printing roller is changed from the conventional circular to a substantially L-shape, and phase difference is provided for the different bearing portions of the typing wheels.

Thus, pressure printing is performed using this invention with a simple structure in accordance with a oscillatingly swinging motion, through a rotation angle of several tens of degrees without continuously rotating the printing roller. Thereby, it is possible to readily accomplish pressure printing. In addition, there is a very advantageous effect in that the peak load torque of the pressure printing is also decreased. Furthermore, since the paper feeding device is arranged after the printing device in the feeding direction of the recording paper, the paper feeding ability is greatly improved and paper jamming is eliminated. Thus, the present invention is most advantageous as a printer for use in point of sale and electronic cash register applications.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing device of small size comprising:

at least one typing wheel having a plurality of selected letters, characters and symbols around the periphery thereof;

selection means for selecting for printing one of said plurality of letters, characters and symbols on said at least one typing wheel;

printing means for printing said selected letter, character or symbol by applying pressure thereto;

feeding means for feeding a recording paper to be printed upon by said printing means, said feeding means being positioned adjacent to said printing means in the feeding direction of said recording paper; and means for moving said printing means in a direction opposite to said feeding direction of said recording paper and for applying said pressure to said printing means to effect printing during said motion of said printing means in said opposite direction.

2. A printing device of small size as claimed in claim 1, wherein a first and a second spring hold said at least one typing wheel in a standby position, said first spring being engaged in a recess in said at least one typing wheel, said second spring being in abuttment with a protruding portion on said at least one typing wheel, whereby rotation of said at least one typing wheel is prevented.

3. A printing device of small size as claimed in claim 2, and further comprising electromagnetic means for releasing said second spring from said abutting engagement with said at least one typing wheel when said electromagnetic means are actuated, whereby said wheel is free to rotate.

4. A printing device of small size as claimed in claim 3, wherein said at least one typing wheel, when rotating, makes sliding contact with said second spring until said spring again abuts said protruding portion, whereby said at least one typing wheel returns to said standby position after de-energization of said electromagnetic means and after printing.

5. A printing device of small size as claimed in claim 1, wherein said feeding means includes rollers holding said recording paper therebetween, said feeding means being adapted to prevent motion of said paper in said opposite direction, said recording paper being held in tension during said motion of said printing means in said opposite direction.

6. A printing device of small size comprising:

at least one typing wheel having a plurality of selected letters, characters and symbols around the periphery thereof;

selection means for selecting for printing one of said plurality of letters, characters and symbols on said at least one typing wheel;

printing means for printing said selected letter, character or symbol selected by said selection means by applying pressure thereto, said printing means including a pair of bearing plates and a crank shaft, said crank shaft, when driven, having an oscillatory motion about a rotational axis, said pair of bearing plates being fixed to said crank shaft and having substantially L-shaped bearing grooves, said bearing grooves having a portion of long radius about said rotational axis of said crank shaft and a portion of shorter radius about said axis, a printing roller engaging said L-shaped bearing grooves of said bearing plates, said printing roller being rotatably held by said grooves, said bearing grooves being adapted to cause said printing roller to engage said long radius portion of said bearing grooves when said bearing plates are driven by said crank shaft rotating in a first direction in said oscillatory motion, and said grooves being further adapted to cause said printing roller to engage said shorter radius portion of said bearing groove when said bearing plates are driven by said oscillatory motion of said crank shaft in a second direction, the distance of said printing roller from said axis of crank rotation being less in said second direction than in said first direction.

7. A printing device of small size as claimed in claim 6, wherein said printing roller presses on the surface of said selected one of said plurality of letters, characters and symbols on said at least one typing wheel when said crank shaft moves in said first direction in said oscillatory motion.

8. A printing device of small size as claimed in claim 7, and further comprising first control means having an open space therethrough, said printing roller pressing said surface of said selected one of said letters, characters, and symbols on said at least one typing wheel through said open space in said first control means during said first direction of motion, said first control means being adapted to separate said printing roller from said surface of said selected one of said letters, characters and symbols on said at least one typing wheel, said separation occurring when said crank shaft moves in said oscillatory motion in said second direction.

9. A printing device of small size as claimed in claim 8, and further comprising feeding means for feeding recording paper to be printed, and wherein said first control means is further adapted to guide said recording paper from said feeding means to said printing means.

10. A printing device of small size as claimed in claim 9, wherein said printer roller cooperates with said first control means in guiding said recording paper between said feeding means and the position where said printer roller presses said selected letter, character or symbol on said at least one typing wheel, said recording paper passing around said printing roller in a standby position prior to printing.

11. A printing device of small size as claimed in claim 6, wherein the number of said typing wheels is at least two, and said L-shaped grooves associated with said printing roller are phase shifted relative to the axis of rotation of said crank shaft, the associated printing roller moving with said phase difference, whereby the selected one of said plurality of letters, characters and symbols on each said typing wheel is not simultaneously printed and the torque requirements for printing are reduced.

12. A printing device of small size as claimed in claim 6, and further comprising feeding means for feeding a recording paper to be printed upon by said printing means, said feeding means being positioned adjacent to a standby position of said printing means in the feeding direction of said recording paper, and means for moving said printing means from said standby position in a direction opposite to said feeding direction of said recording paper and for applying said pressure to said printing means to effect printing.

13. A printing device of small size comprising:

at least one typing wheel having a plurality of letters, characters and symbols around the periphery thereof;

selection means for selecting for printing one of said plurality of letters, characters and symbols on said at least one typing wheel;

a typing wheel shaft, said at least one typing wheel being mounted on said shaft;

second control means for constraining said typing wheel after selection of a letter, character or symbol by said selection means, and for contraining said shaft at a fixed position;

printing means for printing said selected one of said letters, characters and symbols by applying a pressure thereto;

feeding means for feeding recording paper to be printed by said printing means;

said second control means for constraining said typing wheel to said typing wheel shaft including, a cam having a groove, attached to said typing wheel shaft, said second control means further including a groove in said at least one typing wheel, a typing wheel alignment plate, said alignment plate being adapted when in a first position to engage said typing wheel shaft groove and said typing wheel groove concurrently, and to be disengaged from said typing wheel and wheel shaft when in a second position, and means for moving said alignment plate between said first and second positions whereby said typing wheel and said typing wheel shaft are constrained and aligned at the time of printing.

14. A printing device of small size as claimed in claim 13, wherein said alignment plate is pivotably mounted for motion between said first and second positions, said alignment plate consecutively engaging said typing wheel shaft cam groove and said typing wheel groove when pivoted by said means for moving said alignment plate to engage said at least one typing wheel and typing wheel shaft.

15. A printing device of small size and claimed in claim 13, wherein said typing wheel groove and said typing wheel shaft cam groove are radially aligned.

16. A printing device of small size as claimed in claim 1, 7 or 13, and further comprising first control means, said first control means being adapted to separate said printing means from said surface of said selected one of said letters, characters and symbols on said at least one typing wheel, said control means also guiding said recording paper from said feeding means to said printing means.

17. A printing device of small size as claimed in claim 1, 7 or 13, and further comprising take-up means for receiving said recording paper after said paper has been printed by said printing means, said take-up means including a take-up shaft, said take-up shaft, having a longitudinal axis which is not perpendicular to the linear direction of motion of said recording paper, said recording paper passing around said take-up shaft, said recording paper and said take-up shaft being in contact along one linear edge of said recording paper.

18. A printing device of small size as claimed in claim 17, wherein said take-up means further comprises a flange plate, said flange plate being connected with said take-up shaft for rotation therewith, said flange plate tapering in the outward direction from the center of rotation of said take-up shaft, and the other linear edge of said paper moving substantially parallel to said tapered flange plate surface, the contact between said one edge of said recording paper and said take-up shaft forcing said other edge against said tapered surface, whereby said paper is accurately positioned in passing over said take-up means.

19. A printing device of small size as claimed in claim 18, wherein said take-up shaft axis is canted relative to the surface of said recording paper approaching said take-up means.

20. A printing device of small size as claimed in claim 1 or 12, wherein said feeding means includes a first and a second roller having tangential contact with said recording paper moving therebetween, a ratchet wheel affixed to said first feeding roller for rotation therewith, a lever engaging a tooth of said ratchet wheel to hold said feeding rollers stationary, electromagnetic means for moving said lever out of engagement with said ratchet wheel permitting said ratchet wheel to turn and feed said recording paper, and spring return means, said spring return means being adapted to re-engage said lever with the next consecutive tooth on said ratchet wheel, whereby said recoding paper is incrementally fed.

21. A printing device of small size as claimed in claim 1, 13 or 9, and further comprising a motor and gear train means, said motor and gear train means driving said at least one typing wheel and said printing means, said printing means being located between said feeding means and said motor, said printing means operating with oscillatory motion, whereby a printer of small size is constructed.

* * * * *